United States Patent [19]

Meshberg

[11] 4,434,914

[45] Mar. 6, 1984

[54] PERSONAL DEFENSE ACTUATOR

[76] Inventor: Philip Meshberg, 2500 S. Ocean Blvd., Palm Beach, Fla. 33480

[21] Appl. No.: 279,202

[22] Filed: Jun. 30, 1981

[51] Int. Cl.[3] ..... B67D 5/32; B65D 83/00

[52] U.S. Cl. ..... 222/153; 222/192; 222/330; 222/402.11; 222/402.13

[58] Field of Search ..... 222/402.11, 402.12, 222/402.13, 183, 153, 175, 330, 478, 79, 192

[56] References Cited

U.S. PATENT DOCUMENTS

| | | | |
|---|---|---|---|
| 2,629,516 | 2/1953 | Badham | 222/79 |
| 3,202,318 | 5/1964 | Black | 222/330 |
| 3,484,023 | 12/1969 | Meshberg | 222/402.11 |
| 3,776,429 | 12/1973 | DeLucia | 222/192 |
| 4,044,922 | 8/1977 | Bordelon | 222/402.11 |
| 4,220,263 | 9/1980 | Caruso | 222/183 |
| 4,223,804 | 9/1980 | Morris et al. | 222/192 |
| 4,234,351 | 4/1982 | Meshberg | 222/402.11 |
| 4,239,129 | 12/1980 | Esposito | 222/79 |

*Primary Examiner*—Robert B. Reeves
*Assistant Examiner*—Russell D. Stormer
*Attorney, Agent, or Firm*—Kenyon & Kenyon

[57] ABSTRACT

A directional applicator for a self-defense product includes a container having a bottom, side walls and a top; a valve mounted to the top of the container, an actuating stem, having an axial dispensing bore, for the valve, projecting outwardly from the container; an actuator with a first part having therein a spray nozzle disposed on the stem of the nozzle disposed on the stem of the valve with the nozzle in communication with the bore, and a second actuator part fixedly mounted to the container; and a key-ring mounted to the first part which is fixed to the container for axial sliding movement along the applicator between a position where it is adjacent to the actuator and a position where it is spaced from the actuator sufficiently to permit a thumb or finger to be inserted between the key-ring and actuator to operate the actuator to thereby provide a safety feature to prevent accidental actuation.

4 Claims, 5 Drawing Figures

PERSONAL DEFENSE ACTUATOR

BACKGROUND OF THE INVENTION

This invention relates to aerosol dispensers in general and more particularly to a directional applicator useful for self-defense purposes.

There are presently available aerosol dispensers for materials such as mace and tear gas to be used for personal defense when attached. Typically, such applicators are carried by a woman in her purse or in the pocket. Presently available devices generally are directional applicators projecting a single stream of the material. This requires fairly accurate aiming by the persons defending themselves if the use of the dispenser is to be effective. Aiming is particularly difficult at close range and in darkness. In addition, in such dispensers, there is a need to protect against accidental discharge. This is true not only for the person using it but ideally it should not be easy for someone such as a child who gets hold of the dispenser to carry out dispensing accidentally.

Thus, it is the object of the present invention to provide a dispensing package which permits more effectively using a self-defense product at short range and in the darkness, and which also is adapted to prevent accidental discharge.

SUMMARY OF THE INVENTION

The present invention incorporates a number of features which make it particularly effective as a personal defense directional actuator. First of all, rather than having single straight stream, the actuator is designed to project multiple of straight streams, as opposed to a spray. Thus, a wider angular area is covered and a better chance hitting the assailant exists. Although any type of directional actuator can be used, the invention is disclosed in conjunction with an actuator of the type disclosed in my U.S. Pat. No. 3,484,023. An improved version of this applicator, described in co-pending application Ser. No. 173,340, now U.S. Pat. No. 4,324,351 can also be used. This actuator is a two-piece actuator which has an actuating part rotatable between a locked position and an operating position. In accordance with the present invention, either in conjunction with such a locking actuator or independly, a slidable key-ring is mounted over the actuator. The key-ring slides vertically between a position where it is adjacent the actuating button and a position where it is spaced therefrom sufficiently to allow a finger to be inserted. With this arrangement, the actuator serves a dual purpose and furthermore, is available in the person's hand at many of the times when it is most likely to be needed, i.e., when opening a car or apartment door. It is at these times that a person may be particularly subject to attack.

Furthermore, in accordance with the present invention, the dispenser is disposed in a two compartment case. One compartment holds the dispenser itself. The other compartment mounts a battery and bulb forming a flashlight, the light from which is directed in the general direction of streams from the directional actuator. The use of the flashlight offers a number of advantages. First of all, if being used in self-defense, it gives the user some light for aiming. The design is such that one handed operation is possible, the forefinger pressing the actuator and the middle finger operating the flashlight. Secondly, in normal use it is helful in locating the keyhole to insert the key being carried on the dispenser.

In accordance with the present invention, the container for the material being dispensed under pressure is made of tin plate. It is believed that this is safer than aluminum or glass.

DETAILED DESCRIPTION OF THE INVENTION

The present invention will be described in conjunction with an actuator of the type disclosed in my aforementioned U.S. Pat. No. 3,484,023 or such as disclosed in my co-pending application Ser. No. 173,340. However, this is used only as an example and other actuators may also be used. Furthermore, only so much of this actuator as is necessary to understand the operation of the present invention will be described.

Figure 1:
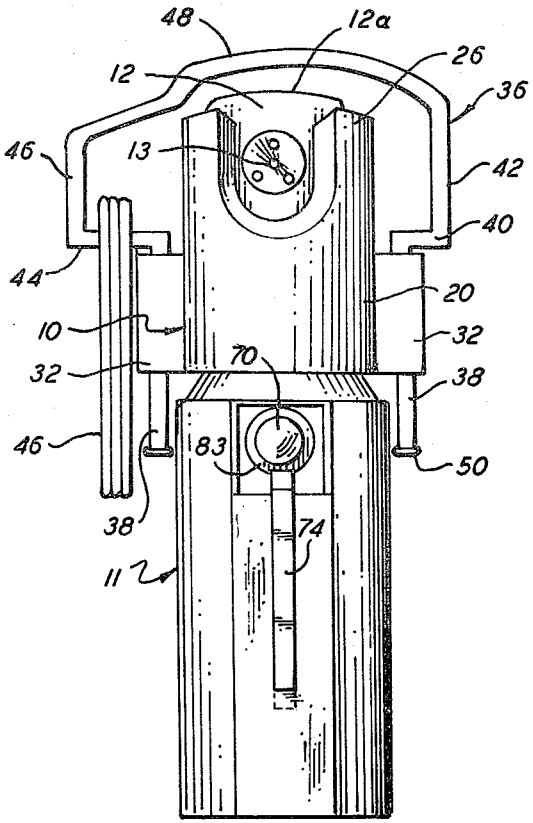
FIG. 1 is a front view of the dispenser according to the present invention.

The actuator of the present invention includes a housing 10 fixedly secured to a container 11 and having a dispensing button 12 provided with nozzles or dispensing orifices 13, which button is rotatably carried by the housing for movement between dispensing and nondispensing positions thereon. Unlike most prior actuators of this nature, and actuators used for dispensing self-defense products, the present invention provides a plurality of orifices 13 directed in different directions to cover an angular range so as to give a spread of streams of material to better insure hitting an assailant. The button has means 14 (FIG. 2) connected thereto for operating a usual valve, or pump, (not shown) carried by the container for controlling the dispensing of material from the container. Hereinafter, dispensing material under pressure with a valve will be assumed. However, it will be recognized that the actuator may equally well be used with a pump dispenser. The button is normally positioned outwardly, as shown in FIG. 1, when the valve is closed. The valve is operated to dispense material from the container in response to inward axial movement of the button on the housing when in the dispensing position thereon. In the dispensing position, the orifices 13 are exposed and the button is free to reciprocate or slide on the housing. Upon rotation of the button to a nondispensing position the nozzle is moved behind a wall on the housing.

The button has a control member or tab 16 for facilitating rotation of the button between the dispensing and nondispensing positions and in the nondispensing position the tab engages a blocking portion 16 of the housing to prevent inward movement of the button so as to operate the dispensing valve.

In the specific illustrated form of the invention the housing 10 comprises a sleeve 20 molded of a suitable thermoplastic material having a shoulder 21 and rib 22 adjacent the open end adapted to snap over the rim 23 of the container and fixedly hold the sleeve in position thereon.

Figure 3:
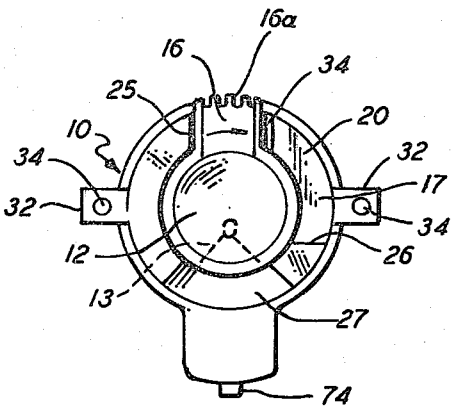
FIG. 3 is a plan view of the dispenser of the present invention.
Figure 2:
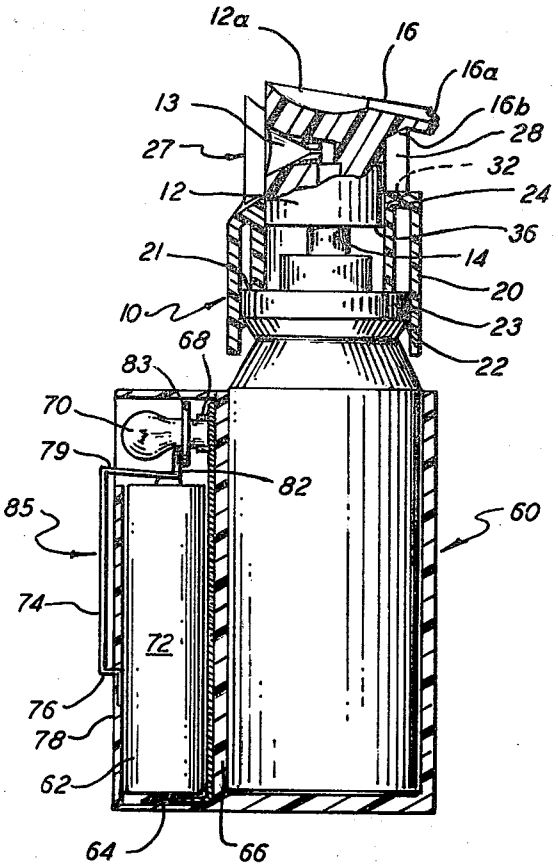
FIG. 2 is a side view, partially in section of the container of the dispenser of the present invention.

The sleeve has a bore 24 in which the button 12 is slidably and rotatably mounted. The nozzle 13 is disposed in the side of the button and the tab 16 extends laterally from the button and projects beyond the side of the sleeve as shown in FIGS. 2 and 3. Preferably, the projecting end of the tab can be provided with serrations 16*a* (FIG. 3) which facilitate the rotation of the button between dispensing and nondispensing positions. The sleeve has stops 25 and 26 (FIG. 3) formed thereon for engaging the tab and limiting the rotation of the button in either of the two positions.

Figure 5:
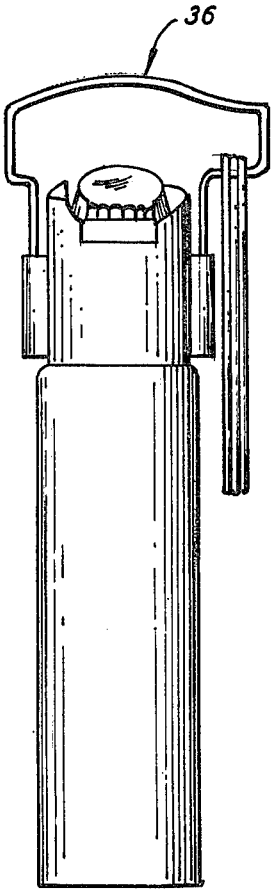
FIG. 5 is a similar view showing the key-ring raised.

When the button is turned to the dispensing position, the sleeve, in order to expose the nozzle 13, has a relatively large elongate opening or slot 27 in the side wall thereof as shown in FIG. 1. Also the sleeve has an elongate open ended slot 28 disposed in the opposite wall thereof, as shown in FIGS. 2 and 5, to receive the tab 16 as the button is moved inwardly, in response to pressure applied to the end wall 12*a*, to operate the valve on the container to dispense material.

Figure 4:
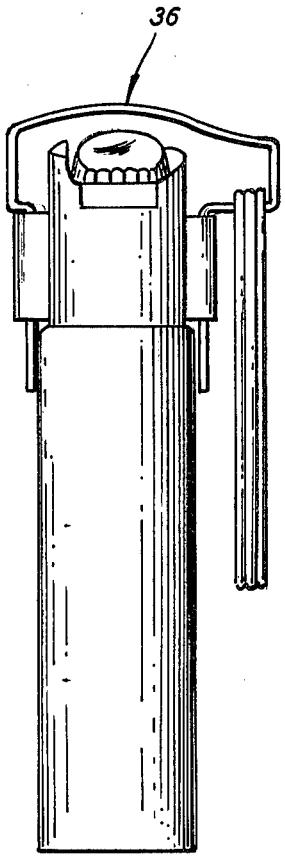
FIG. 4 is a rear view of the dispenser of the present invention with the key-ring in the retracted position.

After a dispensing operation, pressure is removed from the button and it returns to its outward position. Then the tab is engaged and the button turned until the tab contacts the stop 26 and locates the button in the non-dispensing position as shown in FIG. 4. In this position the tab will overlie the portion 17 of the sleeve adjacent the slot 28 which will block any inward movement of the button and prevent accidental operation of the valve.

What has been described so far, is an actuator of the general type described in my aforementioned U.S. Pat. No. 3,484,023 and a device which has been in use for a number of years.

In accordance with the present invention an actuator of this is adapted specifically for use as a personal defense actuator. As indicated above, one feature of the actuator is the plurality of orifices 13 to aid in dispensing over a wider angular range than was possible with prior art devices. A further feature is that the housing 10 contains, on each side thereof, a molded projection 32. Each of the projections 32 contains a bore 34 best seen from the view of FIG. 3. A key-ring 36 is inserted through these bores. For sake of clarity the key-ring is not shown in the view of FIG. 3. The key-ring can slide between two positions. As best seen from FIGS. 4 and 5, the key-ring 36 is moveable from the lowered position shown in FIGS. 1 and 4 to the raised position shown in FIG. 5. Note that in the positions of FIGS. 1 and 4, a finger cannot be inserted between the key-ring and the actuator button 12 and thus accidental operation cannot take place. Thus, even if the button 12 is rotated into the dispensing position, dispensing will not accidentally take place. First, the key-ring must be raised to the position shown in FIG. 5 so that the user can insert a finger in between. Because of this feature, it may be possible to eliminate the locking feature of the two-part actuator. In other words, an actuator in which the part 12 remains rotatably fixed in the position in the Figs., with respect to the housing 10 could be used with the key-ring alone providing for prevention against accidental discharge.

The key-ring includes opposite vertical portions or legs 38 which are inserted through the bores 34, a right angle horizontal portion 40 adjacent to one leg followed by a vertical portion 42. On the other side a longer vertical portion 44 is used to support a plurality of keys 46. This is adjacent a vertical portion 46 which connects with a curved portion 48 extending over the actuator 12. Burrs or the like 50 can be provided on the bottom of the vertical sections 38 to prevent the key-ring from accidentally coming out of the bores 34.

In accordance with a further feature of the present invention, the container 11 in which the personal defense material will be contained is disposed within a chamber sized for that purpose in an outer casing 60. The casing has a second compartment 62 for holding a flashlight. A metallic conductive strip 64 extends from the bottom of compartment 62 along a separating wall 66 to the top of the compartment. Near the top a recess of cylindrical nature 68 is formed. The conductor 64 is molded into this so as to be exposed. A bulb 70 is inserted with its base resting against the conductor 64. A battery 72 is inserted into the compartment and has its cathode in contact with the conductor 64 and its anode in contact with a spring switch 74. One end 76 of the switch 74 is embedded into the outer wall 78 of the case. From this point it extends upwardly to a right angle portion 79 which engages the anode of the battery 72. A portion 82 extending upwardly therefrom is arranged to contact a collar 83 on the bulb, when this switch is pushed in the direction of the arrow 85. Thus, a person using the actuator for self-defense purposes can operate a flashlight in order to aim at the assailant. One handed operation is possible. The forefinger presses on the dispensing button 12 while the middle fingers press in on spring switch 74. In addition, for normal use, the flashlight is quite helful in identifying locks on a car or house when the keys 46 are to be used.

What is claimed is:

1. A directional applicator for a self-defense product comprising:

a. a container having a bottom, side walls and a top;

b. a valve mounted to the top of said container, an actuating stem, having an axial dispensing bore, for said valve, projecting outwardly from said container;

c. an actuator comprising a first part having therein a spray nozzle disposed on the stem of said valve with said nozzle in communication with said bore and a second actuator part fixedly mounted to said container; and d. a key-ring mounted to said second part, which is fixed to said container, for axial sliding movement along the applicator between a position where it is adjacent to said actuator and a position where it is spaced from said actuator sufficiently to permit a thumb or finger to be inserted between said key-ring and actuator to operate said actuator thereby providing a safety feature to prevent accidental actuation.

2. The applicator according to claim 1 wherein said container is made of tin plated steel to permit it to safely withstand high pressure.

3. The applicator according to claim 1 and further including a case having first and second compartments therein, said container inserted into said first compartment and further including battery, a lamp and a switch means for connecting said battery and said lamp mounted in said other compartment, said lamp mounted so that its light is directed in the same direction as that of the streams of material which will exit from said orifices to thereby permit better aiming in darkness.

4. A directional applicator according to claim 1, wherein said key-ring comprises two parallel legs connected by a curved portion and said means for mounting comprise projections on opposite sides of said second part containing axial bores therein through which legs of said key-ring are inserted.

* * * * *